US006978769B2

(12) United States Patent
Höglund et al.

(10) Patent No.: US 6,978,769 B2
(45) Date of Patent: Dec. 27, 2005

(54) METHOD OF CONTROLLING THE INJECTION OF FUEL INTO A COMBUSTION CHAMBER AND A FUEL INJECTION DEVICE FOR PERFORMING SAID METHOD

(75) Inventors: Anders Höglund, Fjaras (SE); Bengt Larsson, Vastra Frolunda (SE)

(73) Assignee: Volvo Technology AB, Gothenburg (SE)

( * ) Notice: Subject to any disclaimer, the term of this patent is extended or adjusted under 35 U.S.C. 154(b) by 0 days.

(21) Appl. No.: 10/486,445

(22) PCT Filed: Aug. 15, 2002

(86) PCT No.: PCT/SE02/01459

§ 371 (c)(1),
(2), (4) Date: Jul. 22, 2004

(87) PCT Pub. No.: WO03/016705

PCT Pub. Date: Feb. 27, 2003

(65) Prior Publication Data

US 2004/0250793 A1 Dec. 16, 2004

(30) Foreign Application Priority Data

Aug. 17, 2001 (SE) ..... 0102756

(51) Int. Cl.[7] ..... F02M 47/02
(52) U.S. Cl. ..... 123/495; 123/446; 417/470
(58) Field of Search ..... 123/445, 446, 123/447, 495, 500–502; 417/470

(56) References Cited

U.S. PATENT DOCUMENTS

| | | | | |
|---|---|---|---|---|
| 3,777,726 | A * | 12/1973 | Knapp et al. | 123/447 |
| 4,471,740 | A | 9/1984 | Jourde et al. | |
| 4,784,101 | A | 11/1988 | Iwanaga et al. | |
| 4,878,471 | A * | 11/1989 | Fuchs | 123/446 |
| 4,951,631 | A | 8/1990 | Eckert | |
| 6,189,509 | B1 | 2/2001 | Froment | |

FOREIGN PATENT DOCUMENTS

| | | |
|---|---|---|
| EP | 0 740 067 | 10/1996 |
| EP | 0 992 675 | 4/2000 |

* cited by examiner

*Primary Examiner*—Thomas Moulis
(74) *Attorney, Agent, or Firm*—Young & Thompson

(57) ABSTRACT

A method of controlling the fuel injection to a combustion chamber (4), comprises the steps of: supplying fuel to a pump (2), which has a piston (7) reciprocating in the a cylinder (6), pressurizing the fuel by applying a force onto the piston (7) by an actuator (8), so that the piston (7) is displaced from a first end position (9) towards a second end position (10), injection of fuel corresponding to a partial volume of the fuel pressurized in the cylinder (6), into the combustion chamber (4), and returning the piston (7) towards the first end position (9) by the pressurized fuel, so that the piston (7) acts with a driving force on the actuator (8). The invention also relates to a fuel injection device for carrying out the method.

13 Claims, 6 Drawing Sheets

Figure 1:
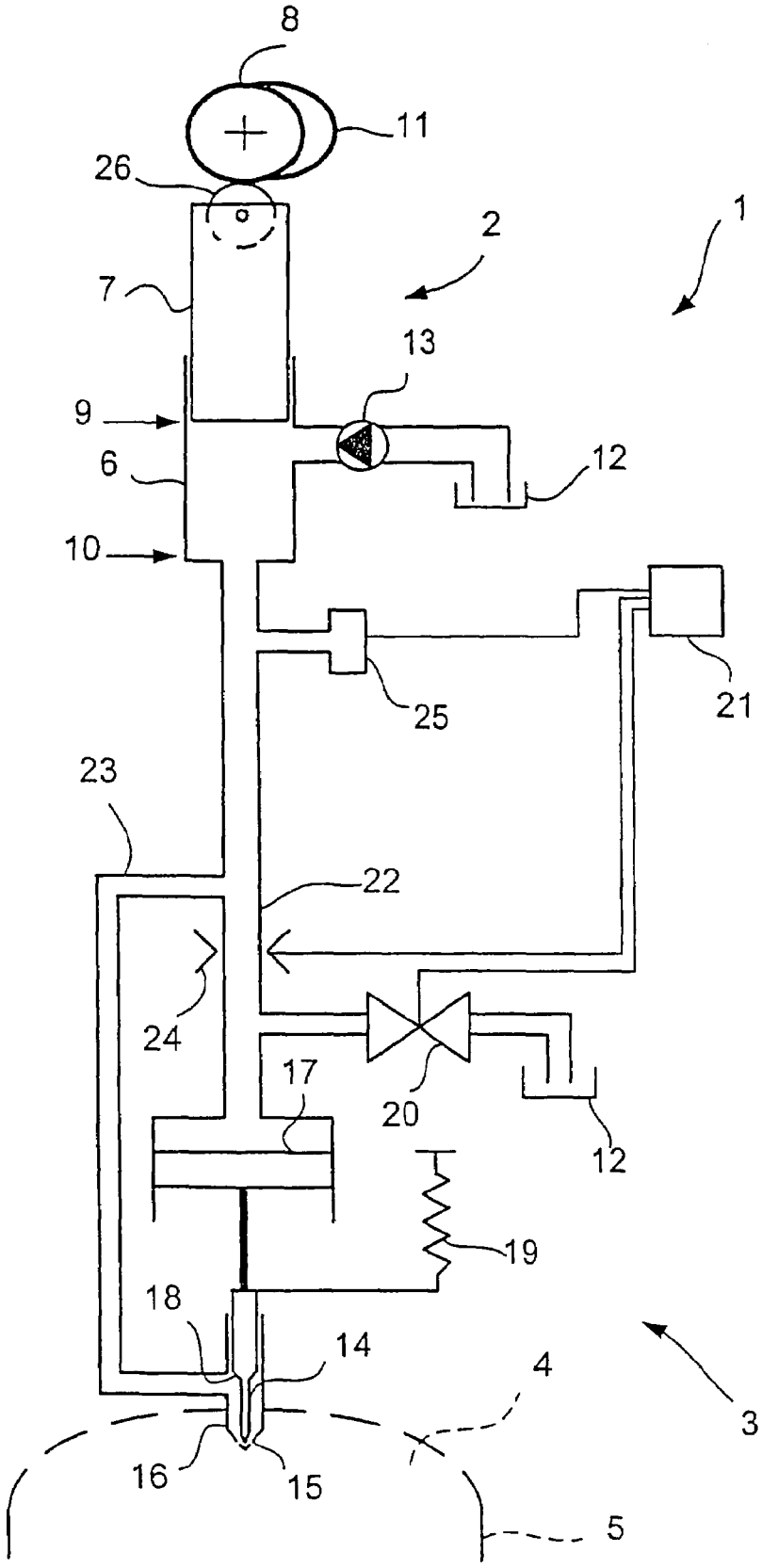

METHOD OF CONTROLLING THE INJECTION OF FUEL INTO A COMBUSTION CHAMBER AND A FUEL INJECTION DEVICE FOR PERFORMING SAID METHOD

The present invention relates to a method of controlling the injection of fuel into a combustion chamber, comprising the steps of: supplying fuel to a pump, which comprises a piston reciprocating in a cylinder, pressurizing the fuel by applying a force to the piston by means of an actuator, so that the piston is moved from a first end position towards a second end position, and injection of fuel, corresponding to a partial volume of the fuel pressurized in the cylinder, into the combustion chamber. The invention also relates to a fuel injection device for performing said method.

Devices for injecting fuel under high-pressure into the combustion chamber of an internal combustion engine have been common for quite some time in diesel engines. Similar fuel injection devices are available, however, for auto engines.

Different fuel injection devices operate according to different principles. Common to all of these devices is that they have a high-pressure pump generating the high-pressure in the fuel which is to be injected into the combustion chamber. Energy is required, however, to drive the high-pressure pump and, if the fuel injection pressure is increased, more energy is required to drive the high-pressure pump. A known type of fuel injection device comprises an injection valve, which is provided with an injection needle, designed to cooperate with at least one injection opening arranged in the injection valve. By actuating the needle with the aid of the fuel pressure, fuel can be injected into the combustion chamber. The fuel pressure, which actuates the needle, is controlled by a spill valve which opens and reduces the pressure in the injection valve when injection of fuel into the combustion chamber is to be stopped. Since the spill valve opens while the fuel pressure is still high, a portion of the pumping work carried out by the high-pressure pump, will be lost. This results in a low efficiency for known injection devices of this type. The opening of the spill valve can also give rise to pressure waves, noise, bubble formation and cavitation in the injection valve and in the high-pressure pump. The pressure waves create pulses in the injection device which negatively affect the fuel injection into the combustion chamber especially when the engine is idling and at low load. The known injection device also requires considerable force and torque in order to build up, in a short period of time, the high-pressure with the aid of the high-pressure pump. This means that a mechanical transmission for driving the injection pump must be dimensioned for large forces and torques, which increases the cost of the mechanical transmission. Another disadvantage of the known device is that if the spill valve breaks down and jams in its closed position so that it cannot open, the injector and/or transmission can break down due to the high fuel pressure.

It is thus a purpose of the present invention to achieve a fuel injection method and a fuel injection device, which require less strength and energy than known fuel injection methods and fuel injection devices.

An additional purpose of the present invention is to achieve a fuel injection method and a fuel injection device, which have higher efficiency than known fuel injection methods and fuel injection devices.

Still another purpose of the present invention is to achieve a fuel injection method and a fuel injection device, which minimize pressure waves, noise, bubble formation and cavitation in the injection valve and in the high-pressure pump.

Still a further purpose of the present invention is to achieve a fuel injection method and a fuel injection device, which can work at a maximum fuel pressure which the high-pressure pump can produce.

Still a further purpose of the present invention is to significantly reduce the maximum torque and tooth forces in the transmission driving the injector pump piston, and the time derivative of the torque and the tooth forces.

This is achieved according to the invention by a method of the type described by way of introduction, where the piston is returned to the first end position by means of the pressurized fuel, so that the piston acts with a driving force on the power means.

This is achieved as well by a fuel injection device of the type described by way of introduction, which comprises a pump arranged to pressurize fuel, an injection valve arranged to inject a partial volume of the pressurized fuel into a combustion chamber, an injection needle arranged in the injection valve, and constructed to cooperate with at least one injection opening arranged in the injection valve, said injection needle being provided with first and second fuel pressure-receiving surfaces, and a control unit disposed to control the injection of the fuel into the combustion chamber. The fuel injection device is characterized by a needle control valve coupled to the injection valve, said needle control valve being disposed to control, by means of signals from the control unit, the fuel pressure acting on the first pressure-receiving surface of the injection needle without substantially affecting the fuel pressure acting on the second pressure-receiving surface of the injection needle.

With such a method for controlling the fuel injection to the combustion chamber and with such a fuel injection device for carrying out the method, the major portion of the energy stored in the pressurized fluid in the fuel injection device can be recovered by returning energy to the actuator during depressurisation of the fuel. Pressure waves, noise, bubble formation and cavitation in the injection valve and in the high-pressure pump will be reduced or be completely eliminated, since fuel under high-pressure does not need to be dumped to halt the injection. Great flexibility in the choice of the fuel injection moment can be obtained, since sharp changes in pressure of the fluid can be avoided. By virtue of the fact that the fuel pressure is built up by the high-pressure pump over a comparatively long period of time, less force is required than in known injection devices to drive the high-pressure pump. This means that a transmission arrangement of relatively small dimension can be used between a driving internal combustion engine and the injection device, thus reducing the cost of components and manufacture for the injection device.

Figure 2:
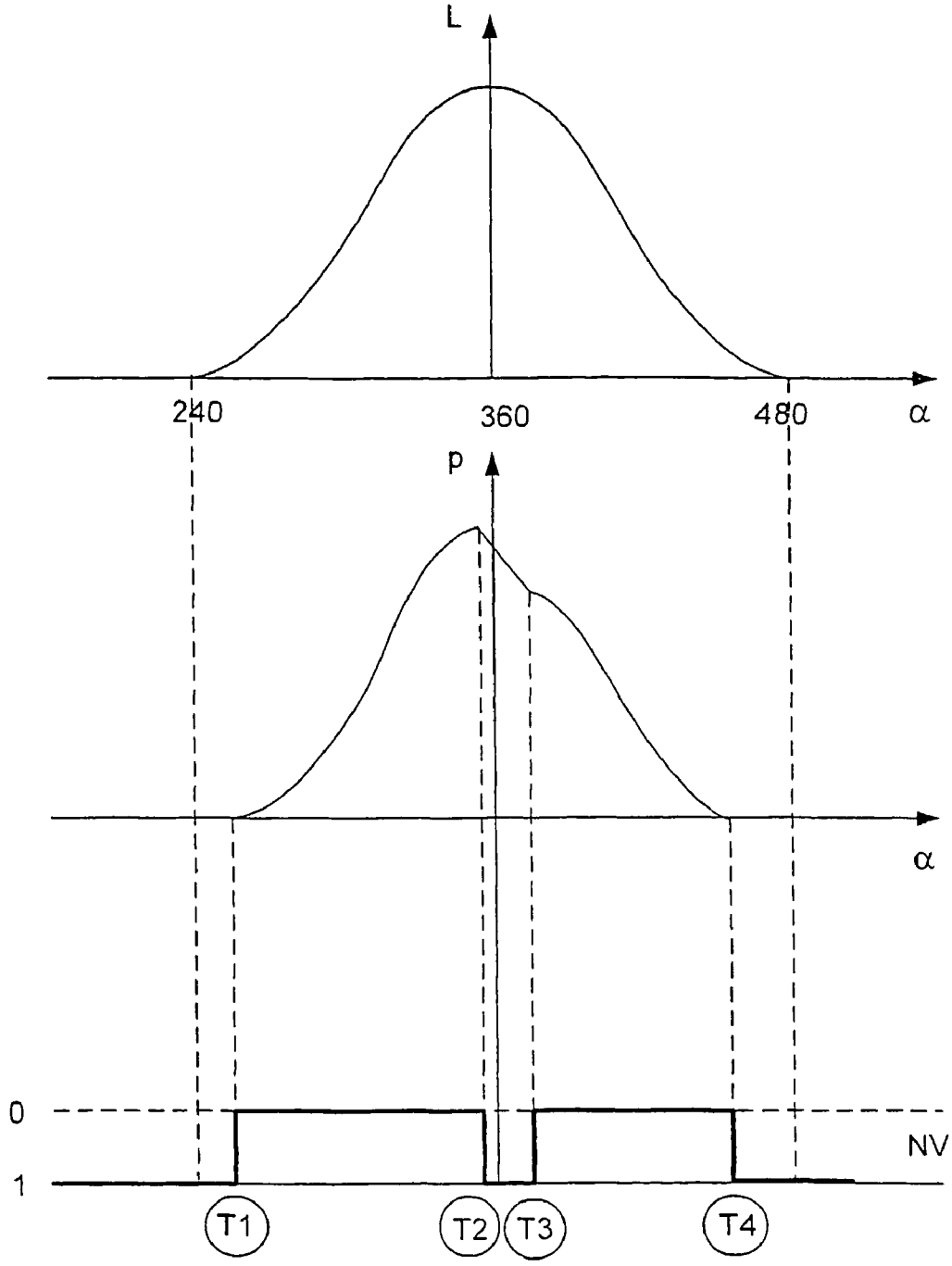
Figure 3:
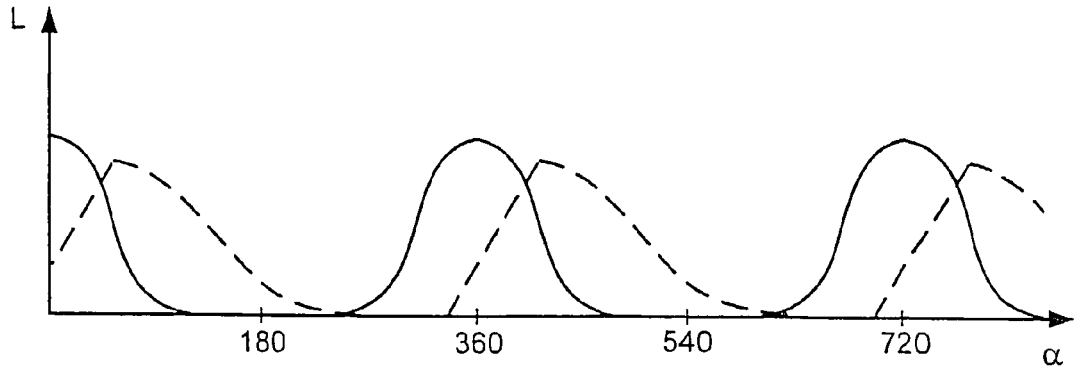
Figure 4:
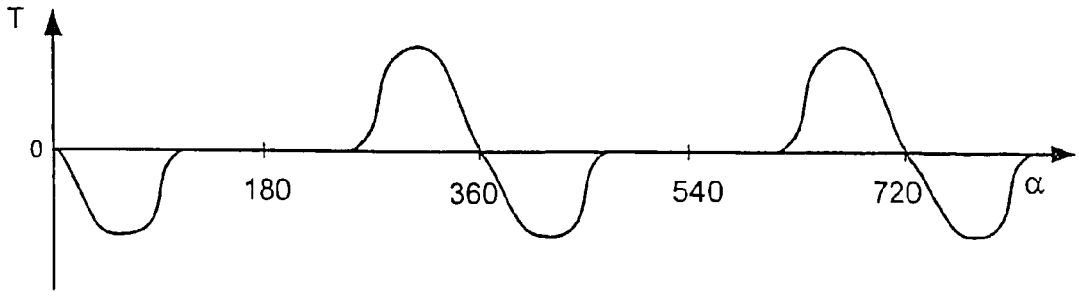
Figure 5:
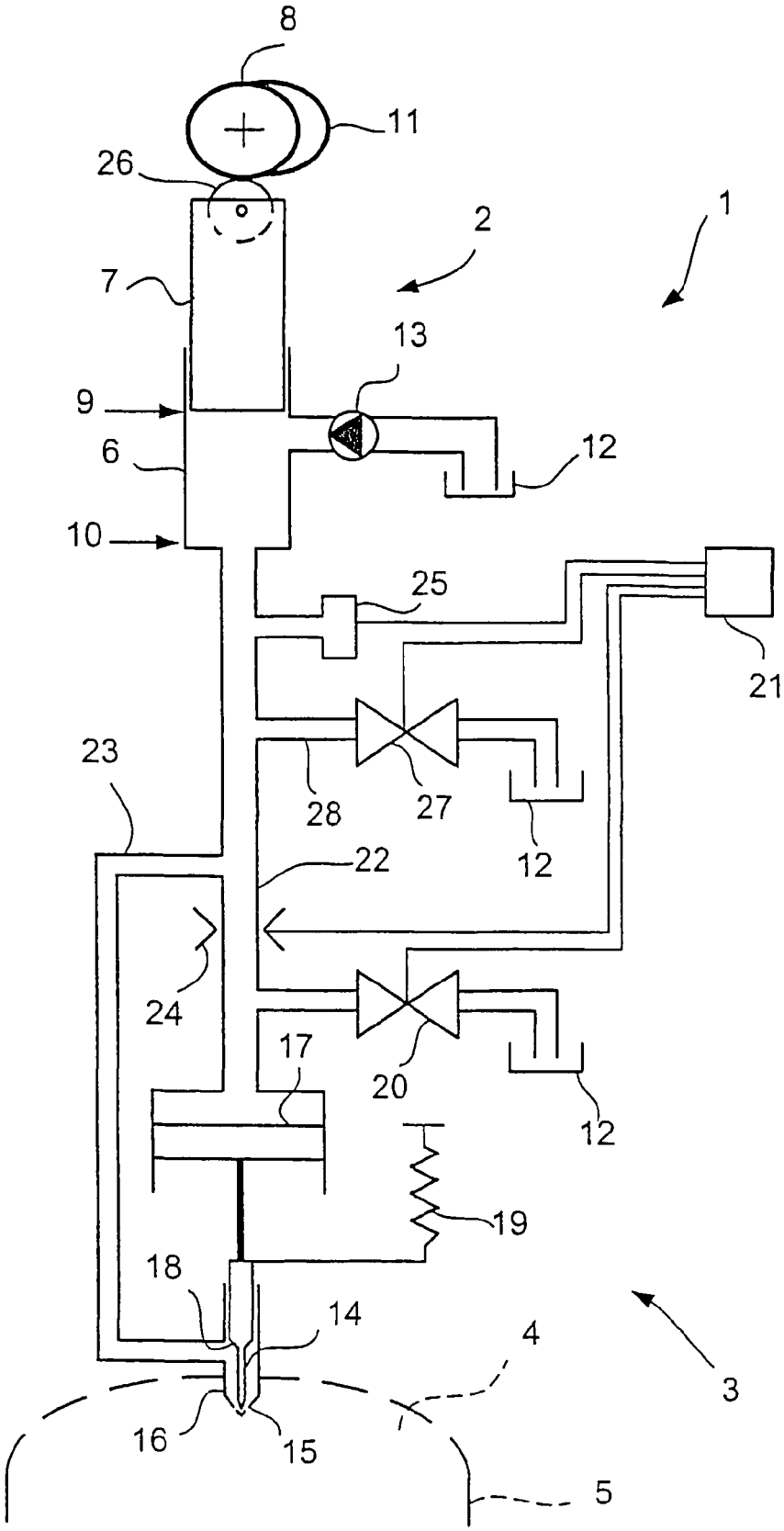
Figure 6:
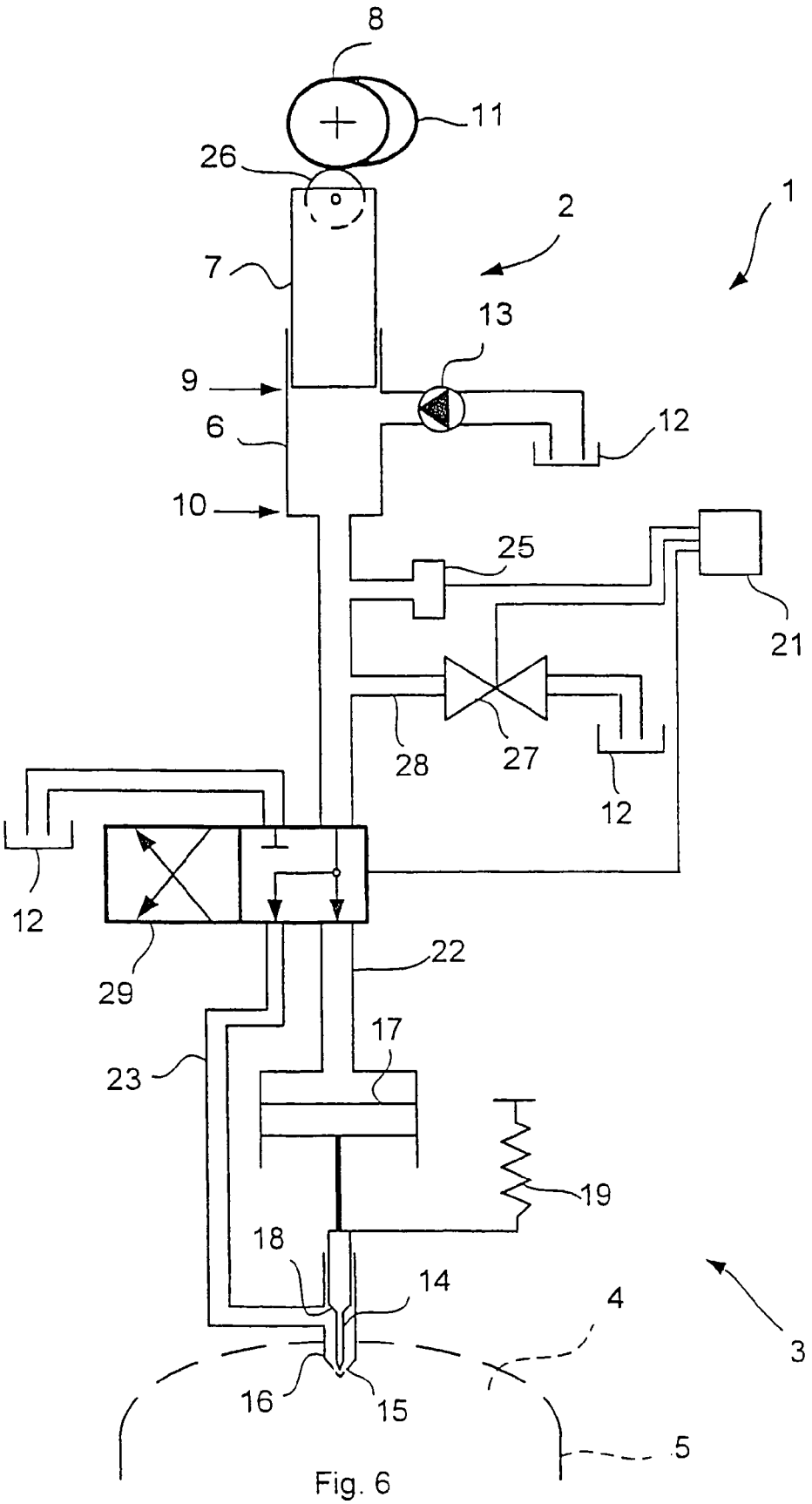
Figure 7:
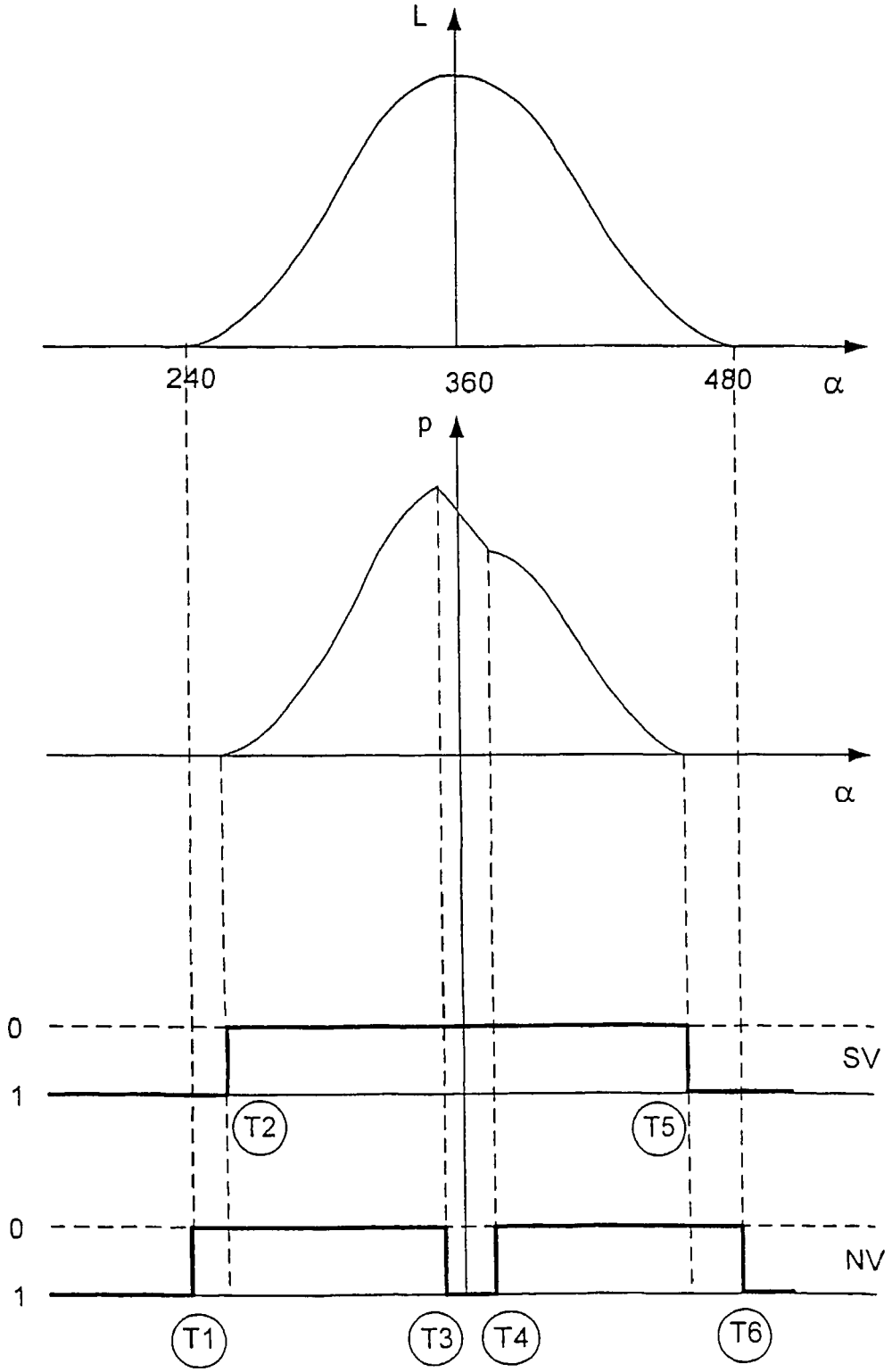

The invention will be described in more detail below with reference to examples shown in the accompanying drawings, of which FIG. 1 shows schematically a first embodiment of a fuel injection device according to the present invention, FIG. 2 shows graphically how the fuel injection device according to a first embodiment is controlled, FIG. 3 shows in graph form the movement of the piston of a high-pressure pump as a function of the rotational angle of the camshaft, FIG. 4 illustrates in a diagram the torque of the camshaft as a function of the rotational angle of the camshaft, FIG. 5 shows schematically a second embodiment of a fuel injection device according to the present invention, FIG. 6 shows schematically a third embodiment of a fuel injection device according to the present invention, and FIG. 7 shows in the form of a diagram how the fuel injection device according to the second and third embodiments is controlled.

FIG. 1 shows schematically a first example of a fuel injection device according to the present invention. The fuel injection device 1 comprises two main components in the form of a high-pressure pump 2, arranged to compress and pressurize fuel, and an injection valve, designed to inject a partial volume of the pressurized fluid into the combustion chamber 4 of an internal combustion engine 5.

The high-pressure pump 2 comprises a piston 7 reciprocated in the cylinder 6. The piston 7 pressurizes the fuel by applying a force via the piston 7 by means of an actuator 8 so that the piston 7 is advanced from a first end position 9 towards a second end position 10. The actuator 8 is a camshaft 8 on which a torque from the internal combustion engine, for example, 5 acts. A cam 11 on the camshaft 8 controls the reciprocating movement of the piston 7 in the cylinder 6. The fuel is supplied to the cylinder 6 from a tank 12 and is fed from the tank 12 to the cylinder 6 by means of a low pressure pump 13. The injection device 1 is made and the high-pressure pump 2 is controlled so that the injection pressure of the pressurized fuel can exceed 2000 bar. In order to achieve this high-pressure, a substantial torque must act on the camshaft 8. By making the cam 11 so that the high-pressure pump 2 builds up the pressure over a relatively long period, the amount of torque required from the camshaft 8 can be reduced. This means that a transmission (not shown) between the driving internal combustion engine and the camshaft 8 can be dimensioned for low torque.

The injection valve 3 comprises an injection needle 14 designed to cooperate with at least one injection opening 15 arranged in the injection valve 3. Two injection openings 15 are shown in FIG. 1. A portion 16 of the injection valve 3 is made to extend into the combustion chamber 4 of the internal combustion engine 5 so that the injection openings 15 will be located in the combustion chamber 4. The injection needle 14 is provided with first and second surfaces 17, 18 subjected to a pressure from the fuel. The first pressure-receiving surface 17 is greater than the second pressure-receiving surface 18. A resilient element 19, such as a compression spring, presses the injection needle 14 towards the injection openings 15. If the force from the fuel pressure acting on the second pressure-receiving surface 18 is greater than the sum of the force from the fuel pressure acting on the first pressure-receiving surface 17 and the force from the spring element 19, the injection needle 14 will be displaced from the injection openings 15 leading to fuel being injected into the combustion chamber 4.

The force acting on the first pressure-receiving surface 17 of the injection needle 14 is controlled by a needle control valve 20 coupled to the injection valve 3. The needle control valve 20 is arranged, in response to signals from a control unit 21, to control the fuel pressure acting on the first pressure-receiving surface 17 of the injection needle 14 without substantially affecting the fuel pressure acting on the second pressure-receiving surface 18 of the injection needle 14. Thus, the control unit 21, by acting on the needle control valve 20 in a predetermined manner, will control the injection of the fuel to the combustion chamber 4. The needle control valve 20 is coupled to a tank 12 in which there is a slight overpressure or atmospheric pressure. By opening the needle control valve 20, the fuel pressure acting on the first pressure-receiving surface 17 of the injection needle 14 will thereby drop.

As can be seen in FIG. 1, a first fuel channel 22 joins the high-pressure pump 2 to the first pressure-receiving surface 17 of the injection needle 14. A second fuel channel 23 connects the high-pressure pump 2 to the second pressure-receiving surface 18 of the injection needle 14. The needle control valve 20 is joined to the first fuel channel 22. So as not to affect to any significant degree the fuel pressure acting on the second surface 18 of the injection needle 14 when the needle control valve 20 opens, there is a choke valve 24 arranged in the first fuel channel 22. The choke valve 24 is coupled to the control unit 21 so that the flow-through area of the choke valve 24 can be controlled by the control unit 21. Alternatively, the choke valve 24 can be provided with a fixed flow-through area. A pressure sensor 25 is coupled to the high-pressure pump 2 and to the injection valve 3. This pressure sensor 25 is arranged to send signals to the control unit 21 related to the pressure of the fuel.

During the injection cycle, there is only injected a partial volume of the total volume of fuel which has been pressurized in the cylinder 6 of the high-pressure pump 2. This means that there will remain pressurized fuel in the injection valve 3, the fuel channels 22, 23 and in the cylinder 6 after fuel has been injected into the combustion chamber 4. The remaining pressurized fuel acts with a force on the piston 7 of the high-pressure pump 2. This force presses the piston 7 towards the first end position 9. When the highest point of the cam 11 has passed the piston 7, which occurs after the piston 7 has reached the second end position 10, the piston 7 will act with a pressure force on the cam 11 in such a way that the piston 7 will drive the camshaft 8. In order to increase smoothness of operation and to reduce friction, a bearing 26 can be arranged between the piston 7 and the camshaft 8.

The fuel injection will thus be controlled as follows:

The fuel is first supplied to the high-pressure pump 2. Thereafter, the fuel is pressurized by applying a force to the piston 7 by means of the camshaft 8, so that the piston is displaced from the first end position 9 towards the second end position 10. Fuel is thereafter injected, corresponding to a partial volume of the fuel pressurized in the cylinder 6, into the combustion chamber 4. After the fuel has been injected into the combustion chamber 8, the piston 7 is returned to the first end position 9 by virtue of the fact that the remaining pressurized fuel in the fuel injection device 1 causes the piston 7 to apply driving force to the camshaft 8. Pressurizing a fuel means in this case that the pressure of the fuel is increased. This can also mean that the pressure of the fuel increases so much that the volume of the pressurized fuel is reduced.

By means of the fuel injection device 1 according to the present invention, the fuel injection timing and duration, i.e. how long and thus how much fuel is to be injected into the combustion chamber 4, can be controlled. FIG. 2 shows in a graph how the fuel injection device 1 according to a first embodiment is controlled. The upper graph shows the movement L of the piston 7 as a function of the camshaft angle $\alpha$ and the lower graph shows the fuel pressure p as a function of the camshaft angle $\alpha$. At the bottom of the figure, a control schedule is shown, showing how the needle control valve 20 is controlled. Displacement of the piston 7 from its first end position 9 to the second end position 10 can be selected so that the displacement begins at a camshaft angle of 240°. It should be noted that the camshaft angle for a certain engine design can be selected to be somewhat phase-shifted relative to the angular position of the crankshaft, i.e. so that the curves in the diagram are shifted somewhat to the right. This will mean, for example, that the displacement of the piston 7 from its first end position 9 can be initiated a few camshaft degrees later than 240°. When this displacement is initiated, the needle control valve 20 is opened as is shown in the control schedule by the needle control valve 20 being activated. Since the needle control valve 20 is open, no fuel pressure will be built up in the injection device 1. The above mentioned phase shift can be optimized with regard to engine efficiency and emissions. The phase shift is zero degrees in all of the embodiments shown. It is, however, possible to introduce a phase shift in all of the embodiments.

At the time T1, the needle control valve 20 is closed so that the pressure of the fuel in the injection device 1 increases. The time T1 can be varied within a limited interval. The earlier T1 is selected, the greater the final pressure will be. At time T2, the needle control valve 20 is opened and fuel is injected into the combustion chamber 4 as has been described above. The fuel injection is cut off by closing the needle control valve 20 at time T3. The points in time T2 and T3 can be varied, depending on when the injection is to be initiated and for how long time the fuel is to be injected, i.e. how great a volume of fuel is to be injected. Between the points of time T3 and T4, the needle control valve 20 is closed so that energy can be returned to the camshaft 8 as will be described in more detail below. The recycling of energy is initiated After the piston 7 has reached the second end position 10, in this embodiment at camshaft angle $\alpha$=360°. It is also at this end position passage that the highest pressure in the fuel injection device 1 can be achieved.

FIG. 3 shows the movement L of the piston 7 of the high-pressure pump 2 as a function of the rotational angle $\alpha$ of the camshaft 8. As can be seen in FIG. 3, the piston 7 will move from the first end position 9 to the second end position 10 during a relatively large camshaft angle $\alpha$. It is during this return to the first end position 9 that energy is returned to the camshaft 8 by the piston 7 exerting a driving force on the camshaft 8. The efficiency of the injection device 1 will thereby increase. The higher the pressure which the injection device is to produce, the greater the energy loss will be. Therefore, recycling of energy to the actuator of the injection device 1 is of great importance. The injection device is thus constructed according to the invention so that the energy losses are minimized. To achieve the reciprocating movement of the piston 7, as shown in FIG. 3, the cam 11 can, for example, have a symmetric shape. The shape of the cam 11, which affects the pressure build-up in the system, can be optimized with regard to engine efficiency and/or vibrations and/or leakage. The dashed line curve in FIG. 3 shows how the piston 7 reciprocates according to known technology, whereby the pressure build-up in the fluid takes place during a relatively short period, requiring substantial force. In order to build up the high fuel pressure, a heavily dimensioned transmission is required between the driving source of the injection device and the injection device itself.

FIG. 4 shows the torque T of the camshaft 8 as a function of the rotational angle $\alpha$ of the camshaft 8. When the piston 7 of the high-pressure pump 2 is pressed by the camshaft 8 towards its second end position 10, the torque T is positive, i.e. the torque T from the camshaft 8 acts on the piston 7. When the piston 7 is in its second end position 10, there is no torque T on the camshaft 8. When the piston 7 is pressed towards its first end position 9 by the fuel pressure in the high-pressure pump 2 and the injection valve 3, the torque T will be negative, which means that the piston 7 will act with a driving force on the camshaft 8.

FIG. 5 shows schematically a second embodiment of a fuel injection device 1 according to the present invention. What distinguishes this embodiment from the first embodiment is that a spill valve 27 has been coupled to the high-pressure pump 2 and the injection valve 3 to reduce the compression force of the fuel in response to signals from the control unit 21. The spill valve 27 is arranged in a branch 28, which leads the fuel to the tank 12. The spill valve 27 is controlled by the control unit 21. The spill valve 27 can be used to control the point in time when the pressure-build up of the fuel is to begin and as a safety valve to avoid excessive pressure.

FIG. 6 shows schematically a third embodiment of a fuel injection device 1 according to the present invention. What distinguishes this embodiment from the first embodiment is that the needle control valve and the choke valve have been replaced by a two-way valve 29, which directs fuel in the first and second fuel channels 22, 23. The two-way valve 29 is controlled by the control unit 21. When the fuel is to be injected into the combustion chamber 4, the two-way valve 29 is controlled so that the first fuel channel 22 is connected to the tank 12.

FIG. 7 shows in graph form how the fuel injection device 1 according to the second and third embodiments is controlled. The upper graph shows the movement L of the piston 7 as a function of camshaft angle $\alpha$, and the lower graph shows the fuel pressure p as a function of the camshaft angle $\alpha$. At the bottom of the Figure, there is shown a control schedule of how the needle control valve 20 is controlled and above this, there is a control schedule of how the spill valve 27 is controlled. At the camshaft angle $\alpha$=240°, the displacement of the piston 7 from its first end position 9 is initiated towards the second end position 10. It should be noted that the previously mentioned phase shift is possible in the second and third embodiments as well, i.e. another angle than 240° can be selected for initiation of the piston displacement. When this displacement begins, at time T1, the spill valve 27 is open and the needle control valve 20 is closed. Since the spill valve 27 is open, there will be no fuel pressure built up in the injection device 1.

At time T2, the spill valve 27 is closed, resulting in increase in the fuel pressure in the injection device 1. Time T2 can be varied within a limited interval. The earlier T2 is placed, the greater will be the final pressure. At time T3, the needle control valve 20 is opened, and fuel will be injected into the combustion chamber 4. The fuel injection is cut off by closing the needle control valve 20 at time T4. Times T2 and T3 can be varied, depending on when the injection is to be initiated and for how long period the fuel is to be injected. Between times T4 and T5, energy is returned to the camshaft 8, as was described above. During this energy return, both the spill valve 27 and the needle control valve 20 are closed. It can be suitable to arrange a pressure limiter somewhere in the injection system to reduce effects of leakage, stiffness in the drive means of the injection system, dead volumes and fuel properties, such as viscosity, temperature, compressibility, etc.

What is claimed is:

1. Method of controlling fuel injection to a combustion chamber, comprising the steps of:

supplying fuel to a pump (2), which comprises a piston (7) reciprocating in a cylinder (6), pressurizing the fuel by applying a force to the piston (7) by means of an actuator (8), so that the piston (7) is moved from a first end position (9) towards a second end position (10), and injection of fuel, corresponding to a partial volume of the fuel pressurized in the cylinder (6), into the combustion chamber (4), characterized by returning the piston (7) towards the first end position (9) by means of the pressurized fuel, so that the piston (7) acts with a driving force on the actuator (8).

2. Method according to claim 1, characterized in that the point in time of injection of the fuel into the combustion chamber (4) and the fuel volume injected into the combustion chamber (4) are controlled by means of a needle control valve (20).

3. Fuel injection device for carrying out the method according to claim 1, comprising:

a pump (2) arranged to pressurize fuel, an injection valve (3) arranged to inject a partial volume of the pressurized fuel into a combustion chamber (4), an injection needle (14) arranged in the injection valve (3), and constructed to cooperate with at least one injection opening (15) arranged in the injection valve (3), said injection needle (14) being provided with first and second fuel pressure-receiving surfaces (17, 18), and a control unit (21) disposed to control the injection of the fuel into the combustion chamber (4), characterized by a needle control valve (20) coupled to the injection valve (3), said needle control valve being disposed to control, by means of signals from the control unit (21), the fuel pressure acting on the first pressure-receiving surface (17) of the injection needle (14) without substantially affecting the fuel pressure acting on the second pressure-receiving surface (18) of the injection needle (14).

4. Fuel injection device according to claim 3, characterized by a first fuel channel (22), which connects the pump (2) to the first receiving surface (17) of the injection needle (14), and a second fuel channel (23), which connects the pump (2) to the second pressure-receiving surface (18) of the injection needle (14).

5. Fuel injection device according to claim 4, characterized in that the needle control valve (20) is connected to the first fuel channel (22).

6. Fuel injection device according to claim 4, characterized in that a choke valve (24) is arranged in the first fuel channel (22).

7. Fuel injection device according to claim 6, characterized in that the flow-through area of the choke valve (24) can be regulated and that the control unit (21) is disposed to control the flow-through area of the choke valve (24).

8. Fuel injection device according to claim 4, characterized in that the needle control valve (20) is constructed as a two-way valve (29) and is joined to the first and second fuel channels (22, 23), so that when the two-way valve (29) is set in a first position, the pump (2) is connected to the first and second pressure-receiving surface (17, 18) of the injection needle (14), and when the two-way valve (29) is set in a second position, the pump (2) only communicates with the second pressure-receiving surface (18) of the injection needle (14).

9. Fuel injection device according to claim 3, characterized in that a spill valve (27) is coupled to the pump (2) and to the injection valve (3) to reduce the maximum pressure of the fuel in response to signals from the control unit (21).

10. Fuel injection device according to claim 3, characterized in that a pressure sensor (25) is coupled to the pump (2) and to the injection valve (3), said pressure sensor (25) being arranged to send signals to the control unit (21) concerning the fuel pressure.

11. Fuel injection device according to claim 3, characterized in that the pump (2) comprises a piston (7) reciprocating in a cylinder (6), said piston being acted on by an actuator (8) in the form of a rotating camshaft.

12. Fuel injection device according to claim 5, characterized in that a choke valve (24) is arranged in the first fuel channel (22).

13. Fuel injection device according to claim 4, characterized in that a spill valve (27) is coupled to the pump (2) and to the injection valve (3) to reduce the maximum pressure of the fuel in response to signals from the control unit (21).

* * * * *